United States Patent [19]

Raasch et al.

[11] Patent Number: 4,472,933

[45] Date of Patent: Sep. 25, 1984

[54] METHOD AND APPARATUS FOR CONTROLLING THE THREAD JOINING PROCESS IN AN OPEN END ROTOR SPINNING MACHINE

[75] Inventors: Hans Raasch, Monchen-Gladbach; Manfred Lassmann, Nettetal, both of Fed. Rep. of Germany

[73] Assignee: W. Schlafhorst & Co., Monchen-Gladbach, Fed. Rep. of Germany

[21] Appl. No.: 441,232

[22] Filed: Nov. 12, 1982

[30] Foreign Application Priority Data

Nov. 11, 1981 [DE] Fed. Rep. of Germany ..... 3144760

[51] Int. Cl.[3] ..... D01H 15/00

[52] U.S. Cl. ..... 57/263

[58] Field of Search ..... 57/263, 264

[56] References Cited

U.S. PATENT DOCUMENTS

| | | | |
|---|---|---|---|
| 3,939,638 | 2/1976 | Bruckert et al. | 57/263 |
| 3,987,610 | 10/1976 | Stahlecker et al. | 57/263 |
| 4,020,621 | 5/1977 | Tsubata | 57/263 |
| 4,020,622 | 5/1977 | Lattion | 57/263 |
| 4,080,775 | 3/1978 | Stahlecker | 57/263 |
| 4,102,116 | 7/1978 | Derichs et al. | 57/263 |
| 4,159,616 | 7/1979 | Takeuchi et al. | 57/263 X |
| 4,172,357 | 10/1979 | Stahlecker et al. | 57/263 |

*Primary Examiner*—Donald Watkins

*Attorney, Agent, or Firm*—Herbert L. Lerner; Laurence A. Greenberg

[57] ABSTRACT

Method for controlling a thread joining process taking place by starting a rotor in an open end rotor spinning machine, which comprises beginning unwinding of the thread, subsequently controlling the thread unwinding speed in accordance with the rotor speed, and controlling at least one of the sliver drawing-in speed and the fiber feeding speed in accordance with the thread unwinding speed, and an apparatus for carrying out the method.

5 Claims, 1 Drawing Figure

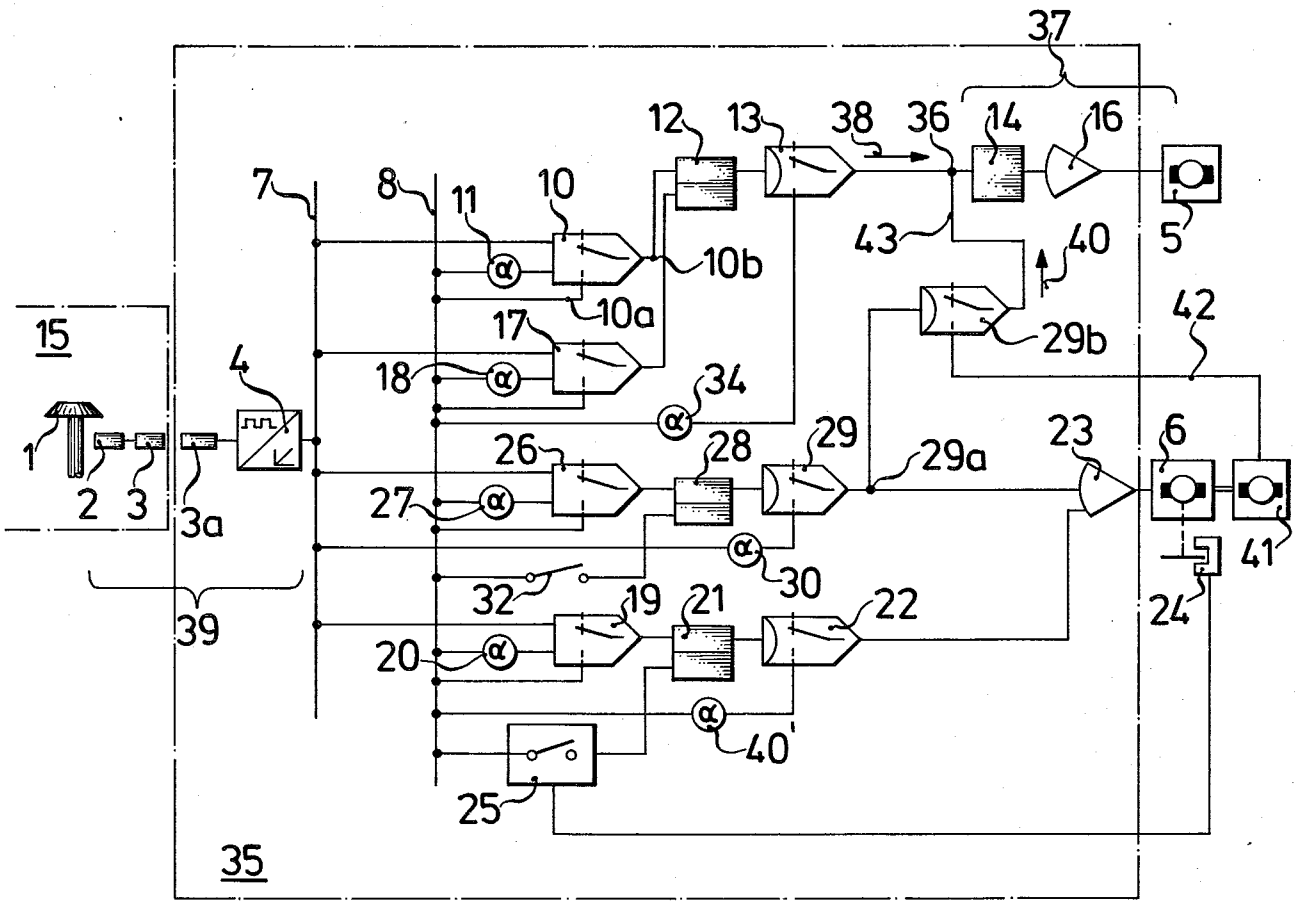
1
2
3
3a
4
5
6
7
8
10
10a
10b
11
12
13
14
15
16
17
18
19
20
21
22
23
24
25
26
27
28
29
29a
29b
30
32
34
35
36
37
38
39
40
40'
41
42
43

METHOD AND APPARATUS FOR CONTROLLING THE THREAD JOINING PROCESS IN AN OPEN END ROTOR SPINNING MACHINE

The invention relates to a method and apparatus for controlling a thread joining or spinning process, which occurs by starting a rotor in an open end rotor spinning machine.

It is known from German Published, Non-Prosecuted Application DEOS No. 26 05 978, to begin to spin or join threads at a slower speed than the normal speed during the starting of the rotor, and thus to start and/or end the individual processes at certain rotor speeds.

A secure thread joining results, when the control is constructed in such a way that the doffing of the thread joininig from the rotor occurs at a rotor speed of between 30,000 and 40,000 revolutions per minute, the so-called thread joining speed. Before this moment, the fiber quantity, which is necessary for the thread joining, must be brought into the rotor as a pre-fed quantity and the thread is combined with the pre-fed fibers. In order for these steps to be finished before the thread joining speed is reached, the thread joining process must begin, for an average starting time to the rotor, at a speed of between 5,000 and 10,000 revolutions per minute.

However, in a disadvantageous manner a high spot or other unevenness develops at the beginning of the thread unwinding, while the sliver drawing-in and the thread unwinding respectively follow the increasing rotor speeds, but its drives have a different mass to accelerate and therefore also have totally different starting times.

It is accordingly an object of the invention to provide a method and apparatus for controlling the thread joining process in an open end rotor spinning machine, which overcomes the hereinafore-mentioned disadvantages of the heretofore-known methods and devices of this general type, and to improve the automatic thread joining, thereby increasing the strength and the evenness of the piecer and the joined thread pieces.

With the foregoing and other objects in view there is provided, in accordance with the invention, a method for controlling a thread joining or spinning process taking place by starting a rotor in an open end rotor spinning machine, which includes beginning unwinding of the thread, subsequently controlling the thread unwinding speed in accordance with the rotor speed, and controlling at least one of the sliver drawing-in speed and/or the fiber feeding speed in accordance with the thread unwinding speed.

In order to carry out the method of the invention, there is provided an apparatus for controlling a thread joining or spinning process taking place by starting a rotor in an open end rotor spinning machine, including at least one spinning unit of the open end rotor spinning machine, a control device connected to the at least one spinning unit for controlling prefeeding of a required fiber quantity for thread joining and for controlling working or commercial spin fiber feed to the rotor, for return of a joined thread end to the rotor and for at least temporary control of thread unwinding from the rotor dependent on rotor speed during the thread joining process, a thread unwinding device and a sliver drawing-in device connected to the control device at least during the thread joining process, and an operative connection disposed from the thread unwinding device to the sliver drawing-in device.

In accordance with another feature of the invention, a fiber feeding device is connected to the control device at least during the thread joining process and is connected to the operative connection.

In accordaance with still an added feature of the invention, the operative connection is switchable.

In accordance with an added feature of the invention, there is provided a control element at which a chosen draft is adjustable for the spinning operation, the control element being disposed in the operative connection.

In accordance with a further feature of the invention, there is provided a tachometer generator connected to the thread unwinding device in the operative connection.

The advantages obtained with the invention exist especially in that during the thread joining process and at the beginning of the normal operation, inadmissible draft changes of the thread are avoided.

The new apparatus can exist at each particular spinning unit of an open end rotor spinning machine. However, this is not necessary if the apparatus is movable and is connected only for the period of the thread joining to an appointed spinning unit. In this case, for the period of the thread joining, a connection can be made from the thread joining apparatus to the thread unwinding apparatus and/or to the sliver drawing-in apparatus or to the fiber feed apparatus of the spinning unit, respectively, such as through plugs.

Other features which are considered as characteristic for the invention are set forth in the appended claims.

Although the invention is illustrated and described herein as embodied in a method and apparatus for controlling the joining thread process in an open end rotor spinning machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single FIGURE of the drawing, which is a diagrammatic and schematic circuit diagram of an embodiment of the invention.

Referring now to the drawing in detail, there is seen a spinning unit 15 of an open end rotor spinning machine, which is not fully represented, and an apparatus 35 for the control of the thread joining process. The apparatus 35 is represented in the form of a block circuit diagram.

The spinning unit 15 has a rotor 1. From the rotor 1 digital impulses proportional to the rotor speed are picked up through a receiver 2 and are transmitted without contact through a converter 3,3*a* from the spinning unit 15 to the input of a digital/analog-converter 4, which supplies a direct current voltage proportional to the rotor speed at its output.

A direct current motor 5, shown in the drawing, is part of a sliver drawing-in apparatus and a direct current motor 6 is part of a combined thread unwinding and thread retracting device. The direct current motor 6 is constructed as a reversing motor. The motors are constructed in such a way that they have a short starting time, and their speed is then adjusted proportional to the applied direct current voltage.

Through the connection with the output of the digital/analog-converter 4, a direct current voltage proportional to the rotor speed is always applied to a line 7. A line 8 has a constant direct current voltage.

The parts 2, 3, 3a and 4 form a common apparatus 39 for the production of rotor signals.

From a line branching point 36, a running cable 37 leads to the direct current motor 5. The running cable 37 contains a control element 14 and an after-connected amplifier 16. Located at the control element 14 is the chosen adjustable draft for the spinning operation.

In the direction of the arrow 38 from the apparatus 39 for the production of rotor signals through the line branching point 36 and the running cable 37, all of the operable components up to the direct current motor 5, which will be described later on in detail, form a common first operative connection. In the direction of the arrow 40 from the direct current motor 6 through the branching point 36 and the running cable 37, all of the operable components, which will be described in detail later on, form a common second operative connection. The running cable 37 is used in common for both working connections.

A first control input of a comparator 10 is connected to the lead 7, and a second control input is connected to the lead 8 through a coefficient potentiometer 11. The connected or operating input 10a of the comparator 10 is also connected to the lead 8. As soon as the expected voltages at the control inputs of the comparator 10 are equal, the connected input 10a will be connected to the output 10b. The potentiometer 11 will be adjusted in such a way that the comparator 10 just changes over when the motor has reached a certain speed $n_1$ at starting, and accordingly the lead 7 has a correspondingly high voltage.

As soon as the comparator 10 has changed over, an after-connected memory 12 is set and connects a digital-/analog circuit or switch 13, which serves as a control apparatus for the prefeeding. The connected or switching input of the circuit 13 is connected to the line 8 through a coefficient potentiometer 34, which serves as the ground setting. The output of the circuit 13 is connected to the lead branching point 36.

In the same manner as the comparator 10, the control inputs of the comparators 17, 26 and 19 are also connected to the lines 7 and 8. The same applies to the connected or switching inputs, which are all connected to the lead 8. The potentiometer 18 is adjusted in such a way that the comparator 17 just changes over, when the rotor has reached a speed $n_3$ by increasing the starting or uptake. The output of the comparator 17 is connected to the erasing input of the memory 12. As soon as the rotor speed $n_3$ is reached, the output of the comparator 17 has a voltage, the memory 12 is erased and the pre-feeding is therby ended.

The potentiometer 20 is adjusted in such a way that the comparator 19 just changes over, when the rotor 1 has reached a speed $n_2$ by starting or accelerating, which is between the speeds $n_1$ and $n_3$. The output of the comparator 19 is connected to a memory 21. As soon as the output of the comparator 19 has a voltage, the memory 21 is set and an after-connected digital-/analog circuit 22 is connected. The connected or operating input of the circuit or switch 22 is connected to the lead 8 through a coefficient potentiometer 40'. The output of the circuit 22 is connected to the direct current motor 6 through an amplifier 23. As soon as the connection is made to the lead 8, the direct current motor 6 starts up in the direction opposite to the unwinding of the thread, for the purpose of rethreading. A thread length measurer 24 constructed as a stepping selector is connected to the control input of a counter 25. A preselected number of steps is reached, which corresponds to the chosen return feed thread length, so that the erasing input of the memory 21 receives a voltage from the line 8 through the counter 25, so that the memory is erased and the circuit or switch 22 opens. After switching off the circuit 22, the direct current motor 6 is immediately stopped again, which for example, can be caused by a conventional brake lift or solenoid device.

The coefficient potentiometer 27 is adjusted in such a way that the comparator 26 just changes over, when the rotor 1 has reached a speed $n_4$ by increasing the starting or accelerating. After the changeover of the comparator 26 its output has a voltage, whereby the after-connected memory 28 is set so that the digital/analog circuit or switch 29 is connected. The connected or switching input of the circuit 29 is connected to the line 7 through the coefficient potentiometer 30. After connecting the circuit 29, a voltage is applied which is a factor smaller then one, at the branching point 29a for the voltage of the lead 7. One branch leads to the control input of a digital/analog circuit 29b and the other branch leads to the direct current motor 6 through the amplifier 23.

A tachometer generator 41 is connected to the direct current motor 6 and is connected with the connected input of the circuit 29b through a line 42. The output of the circuit or switch 29b is connected to the lead branching point 36 by a line 43.

As soon as the lead branching point 29a has a voltage, the circuit 29b is also connected, so that the direct current motor 5 receives a voltage through the second operative connection (arrow 40), which is proportional to the thread unwinding speed, while the tachometer generator 41 is connected to the shaft of the motor 6, which is a part of the sliver drawing-in apparatus.

For the case in which the apparatus 35 is movable and active at a certain spinning unit only during the thread joining process, a switch 32 is provided, which upon closing erases the memory 28, so that the circuit 29 opens again and the motors 5 and 6 come to a standstill. This happens only after handing over the joined thread to the spinning unit and after the simultaneous switching over of the fiber feeding to the fiber feeding drive of the spinning unit.

The previous embodiments indicate that during the pre-feeding, the first operative connection according to the arrow 38, and the beginning of the unwinding of the thread, the second operative connection according to the arrow 40 is effective for drawing-in the sliver to the fiber feed. While the control element 14 is disposed in the running cable 37 which is common for both operative connections, the pre-feeding of a fiber quantity required for the thread joining, as well as the commercial spin feeding, takes place after the chosen draft for the spinning operation. This has the advantage that for each change of the draft, the pre-feeding need not be changed separately.

Known feeding apparatus are equipped with a constantly rotating disentangling roller, which is connected in series with a sliver drawing-in apparatus. The sliver drawing-in apparatus stands still so the supply of the sliver toward the disentangling roller stops. Such an arrangement underlies this embodiment example. Alternatively, the fiber feeding apparatus can be controlled directly.

The above-mentioned tachometer generator need not be limited to a special type. Generally, it is a question of an apparatus which delivers a voltage proportional to the speed.

The foregoing is a description corresponding to German Application No. P 31 44 760.0, dated Nov. 11, 1981, the International Priority of which is being claimed for the instant application, and which is hereby made part of this application. Any discrepancies between the foregoing specification and the aforementioned corresponding German application are to be resolved in favor of the latter.

We claim:

1. Method for controlling a thread joining process taking place by starting a rotor in an open end rotor spinning machine, including a device for measuring the speed of the rotor, a thread unwinding apparatus connected to the measuring device, a sliver drawing-in apparatus connected to the unwinding apparatus, and a fiber feeding apparatus connected to the unwinding apparatus, which comprises beginning unwinding of the thread with the thread unwinding apparatus, subsequently adjusting the thread unwinding speed of the thread unwinding apparatus in accordance with the rotor speed, and adjusting at least one of the sliver drawing-in speed of the sliver drawing-in apparatus and the fiber feeding speed of the fiber feeding apparatus in accordance with the thread unwinding speed.

2. Apparatus for controlling a thread joining process taking place by starting a rotor in an open end rotor spinning machine, comprising at least one spinning unit of the open end rotor spinning machine, means for measuring the speed of the rotor, a control device connected to said measuring means, a thread unwinding device connected to said control device at least during the thread joining process, a sliver drawing-in device connected to said control device at least during the thread joining process, a fiber feeding device connected to said control device at least during the thread joining process, and an operative connection from said thread unwinding device to said sliver drawing-in device, said control device controlling prefeeding of a required fiber quantity from said fiber feeding device for thread joining, said control device controlling fiber feed from said fiber feedng device to the rotor, said control device returning a joined thread end to the rotor with said thread unwinding device, and said control device at least temporarily controlling thread unwinding from the rotor with said thread unwinding device dependent on rotor speed during the thread joining process.

3. Apparatus according to claim 2, wherein said operative connection is switchable.

4. Apparatus according to claim 2, including a control element at which a chosen draft is adjustable for the spinning operation, said control element being disposed in said operative connection.

5. Apparatus according to claim 2, including a tachometer generator connected to said thread unwinding device in said operative connection.

* * * * *